US012618582B2

(12) United States Patent
Zhao et al.

(10) Patent No.: US 12,618,582 B2
(45) Date of Patent: May 5, 2026

(54) AIR CONDITIONER AND CONTROL METHOD THEREOF

(71) Applicant: QINGDAO HISENSE HITACHI AIR-CONDITIONING SYSTEMS CO., LTD., Shandong (CN)

(72) Inventors: Yulei Zhao, Shandong (CN); Haibin Lu, Shandong (CN); Heng Zhang, Shandong (CN); Chen Dong, Shandong (CN); Jia Peng, Shandong (CN); Tingyu Li, Shandong (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 398 days.

(21) Appl. No.: 18/485,505

(22) Filed: Oct. 12, 2023

(65) Prior Publication Data

US 2024/0044542 A1 Feb. 8, 2024

Related U.S. Application Data

(63) Continuation of application No. PCT/CN2021/138239, filed on Dec. 15, 2021.

(30) Foreign Application Priority Data

Jul. 7, 2021 (CN) ..... 202110768135.2

(51) Int. Cl.
*F24F 11/67* (2018.01)
*F24F 3/153* (2006.01)
(Continued)

(52) U.S. Cl.
CPC ..... *F24F 11/67* (2018.01); *F24F 3/153* (2013.01); *F24F 2110/10* (2018.01); *F24F 2110/20* (2018.01)

(58) Field of Classification Search
None
See application file for complete search history.

(56) References Cited

U.S. PATENT DOCUMENTS 10,132,530 B2 * 11/2018 Liu ..... F25B 41/34
2015/0059392 A1 * 3/2015 Chi ..... F24D 19/1039 237/69

(Continued)

FOREIGN PATENT DOCUMENTS

CN 1963324 A 5/2007
CN 102466298 A 5/2012

(Continued)

OTHER PUBLICATIONS

International Search Report and Written Opinion dated Apr. 6, 2022 in corresponding International Application No. PCT/CN2021/138239, translated, 20 pages.

(Continued)

*Primary Examiner* — Redhwan K Mawari

(74) *Attorney, Agent, or Firm* — MH2 TECHNOLOGY LAW GROUP LLP

(57) ABSTRACT

Some embodiments of the present disclosure provide an air conditioner and a control method thereof. The air conditioner includes an outdoor unit, an indoor unit, a temperature sensor, a humidity sensor, and a controller. The temperature sensor is configured to detect a first indoor temperature and a second indoor temperature. The humidity sensor is configured to detect a first indoor humidity and a second indoor humidity. The controller is configured to control the air (Continued)

conditioner to operate in a reheat dehumidification mode if it is determined that a first preset condition is satisfied, control the air conditioner to operate in a cooling mode if it is determined that the first preset condition is not satisfied, and control the air conditioner to enter a shutdown state if it is determined that one of a second preset condition and a third preset condition is satisfied.

20 Claims, 8 Drawing Sheets

(51) Int. Cl.
*F24F 110/10* (2018.01)
*F24F 110/20* (2018.01)

(56) References Cited

U.S. PATENT DOCUMENTS

2015/0316278 A1* 11/2015 Chi ..... F24F 5/001 62/160
2017/0250629 A1* 8/2017 Li ..... G05B 15/02
2019/0072307 A1* 3/2019 Liu ..... F04B 39/0207
2019/0242610 A1* 8/2019 Liu ..... F25B 49/02
2021/0191891 A1* 6/2021 Shi ..... G06F 13/4291
2022/0120472 A1* 4/2022 Zhao ..... F25B 9/008
2022/0252300 A1* 8/2022 Zhang ..... F24F 13/222

FOREIGN PATENT DOCUMENTS

CN 103411341 A 11/2013
CN 104833044 A 8/2015
CN 111425948 A 7/2020
CN 111442507 A 7/2020
CN 112013472 A 12/2020
CN 112797659 A 5/2021
CN 113587382 A 11/2021
CN 115751514 A 3/2023
JP 2001153397 A 6/2001
JP 2002089998 A 3/2002
KR 1020040033802 A 4/2004

OTHER PUBLICATIONS

Chinese First Office Action dated Jun. 1, 2022 in corresponding Chinese Application No. 202110768135.2, translated, 15 pages.

* cited by examiner

AIR CONDITIONER AND CONTROL METHOD THEREOF

CROSS-REFERENCE TO RELATED APPLICATIONS

This application is a continuation application of International Application No. PCT/CN2021/138239, filed on Dec. 15, 2021, which claims priority to Chinese Patent Application No. 202110768135.2, filed on Jul. 7, 2021, which are incorporated herein by reference in their entirety.

TECHNICAL FIELD

The present disclosure relates to the field of air conditioning technologies, and in particular, to an air conditioner and a control method thereof.

BACKGROUND

A humid environment may harm health of human body and may cause damage to furniture, appliances, and clothing. In a case where an air conditioner is operating in a reheat dehumidification mode, that is, the air conditioner heats dehumidified cold air and then sends it indoors, so that an indoor temperature is usually lower than a target temperature, resulting in low user comfort.

SUMMARY

In an aspect, an air conditioner is provided. The air conditioner includes an outdoor unit, an indoor unit, a temperature sensor, a humidity sensor, and a controller. The outdoor unit includes a compressor. The compressor is configured to compress a refrigerant. The indoor unit includes an indoor fan. The indoor fan is configured to supply air indoors. The temperature sensor is configured to detect a first indoor temperature and a second indoor temperature. The humidity sensor is configured to detect a first indoor humidity and a second indoor humidity. The controller is configured to obtain the first indoor temperature, a first target temperature, the first indoor humidity, and a first target humidity at a first moment, control the air conditioner to operate in a reheat dehumidification mode if it is determined that a fifth preset condition is satisfied, and control the air conditioner to operate in a cooling mode if it is determined that the fifth preset condition is not satisfied. The reheat dehumidification mode refers to a mode that the air conditioner heats dehumidified cold air before sending the dehumidified cold air indoors. The controller is further configured to, after controlling the air conditioner to operate in the reheat dehumidification mode, obtain the second indoor temperature, the second indoor humidity, a second target temperature, and a second target humidity at a second moment, the second moment is after the first moment, and control the air conditioner to enter a shutdown state if it is determined that one of a second preset condition and a third preset condition is satisfied. The fifth preset condition includes that the first indoor temperature is less than or equal to a sum of the first target temperature and a first preset temperature, the first indoor temperature is greater than the first target temperature, and the first indoor humidity is greater than or equal to a difference between the first target humidity and a first preset humidity. The second preset condition includes that the second indoor temperature is outside a temperature range, an upper limit value of the temperature range is equal to a sum of the second target temperature and a second preset temperature, and a lower limit value of the temperature range is equal to a difference between the second target temperature and the second preset temperature. The third preset condition includes that the second indoor temperature is within the temperature range, and the second indoor humidity is less than or equal to a difference between a second target humidity and a first preset humidity.

In another aspect, a control method of an air conditioner is provided. The control method is applied to an air conditioner according to any one of the above embodiments. The control method includes that obtaining the first indoor temperature, a first target temperature, the first indoor humidity, and a first target humidity at a first moment, controlling the air conditioner to operate in a reheat dehumidification mode if it is determined that a fifth preset condition is satisfied, and controlling the air conditioner to operate in a cooling mode if it is determined that the fifth preset condition is not satisfied. The reheat dehumidification mode refers to a mode that the air conditioner heats dehumidified cold air before sending the dehumidified cold air indoors. The fifth preset condition includes that the first indoor temperature is less than or equal to a sum of the first target temperature and a first preset temperature, the first indoor temperature is greater than the first target temperature, and the first indoor humidity is greater than or equal to a difference between the first target humidity and a first preset humidity. The control method further includes that after controlling the air conditioner to operate in a reheat dehumidification mode if it is determined that a fifth preset condition is satisfied, obtaining a target temperature and a target humidity in a current cycle, determining a target evaporation temperature in the reheat dehumidification mode according to the target temperature and the target humidity in the current cycle, and adjusting a rotational speed of the compressor according to the target evaporation temperature. The target evaporation temperature is a temperature that the indoor heat exchanger as an evaporator needs to reach.

In yet another aspect, an air conditioner is provided. The air conditioner includes an outdoor unit, an indoor unit, a temperature sensor, a humidity sensor, and a controller. The outdoor unit includes a compressor. The compressor is configured to compress a refrigerant. The indoor unit includes an indoor fan. The indoor fan is configured to supply air indoors. The temperature sensor is configured to detect a first indoor temperature and a second indoor temperature. The humidity sensor is configured to detect a first indoor humidity and a second indoor humidity. The controller is configured to obtain the first indoor temperature and a first target temperature at a first moment, control the air conditioner to operate in a reheat dehumidification mode if it is determined that a first preset condition is satisfied, and control the air conditioner to operate in a cooling mode if it is determined that the first preset condition is not satisfied. The reheat dehumidification mode refers to a mode that the air conditioner heats dehumidified cold air before sending the dehumidified cold air indoors. The controller is further configured to, after controlling the air conditioner to operate in the reheat dehumidification mode, obtain the second indoor temperature and a second target temperature at a second moment, and control the air conditioner to enter a shutdown state if it is determined that one of a second preset condition and a third preset condition is satisfied. The first preset condition includes that the first indoor temperature is less than or equal to a sum of the first target temperature and a first preset temperature, and the first indoor temperature is greater than the first target temperature. The second preset condition includes that the second indoor temperature is outside a temperature range, an upper limit value of the temperature range is equal to a sum of the second target temperature and a second preset temperature, and a lower limit value of the temperature range is equal to a difference between the second target temperature and the second preset temperature. The third preset condition includes that the second indoor temperature is within the temperature range, and the second indoor humidity is less than or equal to a difference between a second target humidity and a first preset humidity.

In yet another aspect, a control method of an air conditioner is provided. The air conditioner includes an outdoor unit, an indoor unit, a temperature sensor, a humidity sensor, and a controller. The outdoor unit includes a compressor. The compressor is configured to compress a refrigerant. The indoor unit includes an indoor fan. The indoor fan is configured to supply air indoors. The temperature sensor is configured to detect a first indoor temperature and a second indoor temperature. The humidity sensor is configured to detect a first indoor humidity and a second indoor humidity. The controller is coupled to the compressor, the indoor fan, the temperature sensor, and the humidity sensor. The control method includes that obtaining the first indoor temperature and a first target temperature at a first moment, controlling the air conditioner to operate in a reheat dehumidification mode if it is determined that a first preset condition is satisfied, and controlling the air conditioner to operate in a cooling mode if it is determined that the first preset condition is not satisfied. The reheat dehumidification mode refers to a mode that the air conditioner heats dehumidified cold air before sending the dehumidified cold air indoors. The first preset condition includes that the first indoor temperature is less than or equal to a sum of the first target temperature and a first preset temperature, and the first indoor temperature is greater than the first target temperature. The control method further includes that after controlling the air conditioner to operate in a reheat dehumidification mode, if it is determined that a first preset condition is satisfied, obtaining a target temperature and a target humidity in a current cycle, determining a target evaporation temperature in the reheat dehumidification mode according to the target temperature and the target humidity in the current cycle, and adjusting a rotational speed of the compressor according to the target evaporation temperature. The target evaporation temperature is a temperature that the indoor heat exchanger as an evaporator needs to reach.

DETAILED DESCRIPTION

Figure 1:
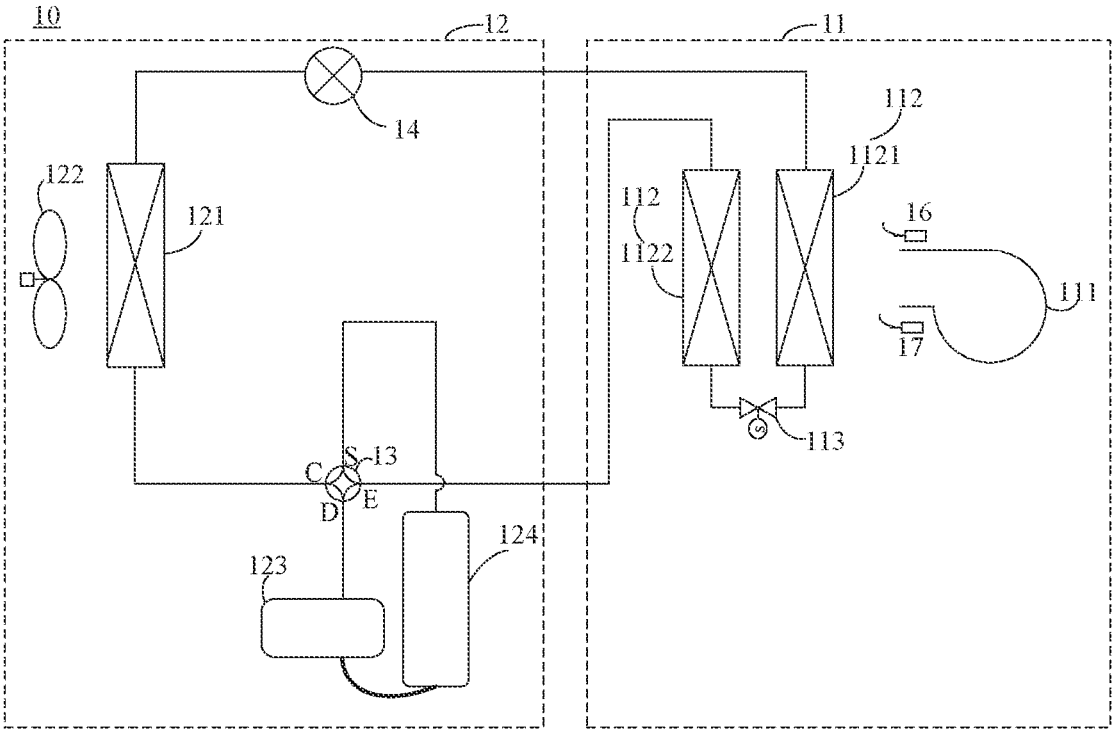
FIG. 1 is a structural diagram of an air conditioner, in accordance with some embodiments.

Some embodiments of the present disclosure will be described clearly and completely with reference to the accompanying drawings. However, the described embodiments are merely some but not all of embodiments of the present disclosure. All other embodiments obtained by a person having ordinary skill in the art based on embodiments of the present disclosure shall be included in the protection scope of the present disclosure.

Unless the context requires otherwise, throughout the specification and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment," "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, features defined as "first" and "second" may explicitly or implicitly include one or more of the features. In the description of the embodiments of the present disclosure, the term "a plurality of" or "the plurality of" means two or more unless otherwise specified.

In the description of some embodiments, the terms "coupled" and "connected" and their derivatives may be used. The term "connected" should be understood in a broad sense: for example, "connected" may represent a fixed connection, a detachable connection, or connected as an integral body; "connected" may be directly "connected" or indirectly "connected" through an intermediate means. The term "coupled" may be used in the description of some embodiments to indicate that two or more components are in direct physical or electrical contact with each other. The term "coupled" or "communicatively coupled," however, may also mean that two or more components are not in direct contact with each other, but still cooperate or interact with each other. The embodiments disclosed herein are not necessarily limited to the content herein.

The phrase "A and/or B" includes the following three combinations: only A, only B, and a combination of A and B.

The use of "applicable to" or "configured to" herein indicates an open and inclusive expression, which does not exclude devices that are applicable to or configured to perform additional tasks or steps.

In addition, the phrase "based on" used herein has an open and inclusive meaning, since a process, step, calculation, or other action that is "based on" one or more of the stated conditions or values may, in practice, be based on additional conditions or values exceeding those stated.

Some embodiments of the present disclosure provide an air conditioner 10. The air conditioner 10 has a reheat dehumidification mode. The reheat dehumidification mode refers to a mode that the air conditioner 10 heats dehumidified cold air and sends it indoors, so as to reduce effect of the dehumidified cold air on the indoor temperature. An indoor unit of the air conditioner 10 that has the reheat dehumidification mode includes two heat exchangers. One of the two heat exchangers is used for cooling and dehumidification, and another of the two heat exchangers is used for heating. FIG. 1 is a structural diagram of an air conditioner, in accordance with some embodiments. As shown in FIG. 1, the air conditioner 10 includes an indoor unit 11, an outdoor unit 12, a four-way valve 13, an expansion valve 14, and a controller 15 (see FIG. 13).

The indoor unit 11 includes an indoor fan 111, an indoor heat exchanger 112 and a dehumidification solenoid valve 113. The outdoor unit 12 includes an outdoor heat exchanger 121, an outdoor fan 122, a compressor 123, and a gas-liquid separator 124.

The compressor 123, a condenser (the indoor heat exchanger 112 or the outdoor heat exchanger 121), the expansion valve 14, and an evaporator (the outdoor heat exchanger 121 or the indoor heat exchanger 112) perform a refrigerant cycle of the air conditioner 10. The refrigerant cycle includes a series of processes involving compression, condensation, expansion, and evaporation and circularly supplies the refrigerant to the regulated side.

The indoor heat exchanger 112 includes a first indoor heat exchanger 1121 and a second indoor heat exchanger 1122. The indoor heat exchanger 112 is configured to liquefy or vaporize the refrigerant by exchanging heat between the indoor air and the refrigerant conveyed in the indoor heat exchanger 112. The outdoor heat exchanger 121 is configured to vaporize or liquefy the refrigerant by exchanging heat between the outdoor air and the refrigerant conveyed in the outdoor heat exchanger 121.

It will be noted that in a case where the indoor heat exchanger 112 is configured to liquefy the refrigerant, the indoor heat exchanger 112 is configured to vaporize the refrigerant. In a case where the indoor heat exchanger 112 is configured to vaporize the refrigerant, the indoor heat exchanger 112 is configured to liquefy the refrigerant.

For example, the indoor heat exchanger 112 operates as an evaporator in a case where the air conditioner 10 operates in a cooling mode, so that the refrigerant, which has dissipated heat through the outdoor heat exchanger 121, absorbs heat from the indoor air through the indoor heat exchanger 112 to be evaporated. The outdoor fan 122 is configured to promote heat-exchange between the refrigerant flowing in a heat transfer pipe of the outdoor heat exchanger 121 and the outdoor air, and the indoor fan 111 is configured to promote heat-exchange between the refrigerant flowing in a heat transfer pipe of the indoor heat exchanger 112 and the indoor air, so as to assist in temperature regulation.

In some embodiments, the first indoor heat exchanger 1121 is disposed proximate to the indoor fan 111 along an air-outlet direction of the indoor fan 111, and the second indoor heat exchanger 1122 is disposed away from the indoor fan 111 along the air-outlet direction of the indoor fan 111. The airflow formed by the indoor air passing through the indoor fan 111 passes through the first indoor heat exchanger 1121 and the second indoor heat exchanger 1122 in sequence. In a case where the air conditioner 10 operates in the reheat dehumidification mode, the first indoor heat exchanger 1121 operates as an evaporator, and the second indoor heat exchanger 1122 operates as a condenser. The indoor air is sucked into the air conditioner 10 by the indoor fan 111 to form an airflow, the airflow is first cooled and dehumidified by the first indoor heat exchanger 1121, and then heated by the second indoor heat exchanger 1122, so as to achieve the effect of reheating and dehumidifying the indoor air.

However, in a case where the air conditioner 10 operates in the heating mode, both the first indoor heat exchanger 1121 and the second indoor heat exchanger 1122 operate as condensers. In this case, the airflow first exchanges heat with the first indoor heat exchanger 1121 to heat up, and then passes through the second indoor heat exchanger 1122 to heat up again. In this way, an initial temperature of the airflow at the first indoor heat exchanger 1121 is lower than an initial temperature of the airflow at the second indoor heat exchanger 1122. Since a temperature of a refrigerant in the first indoor heat exchanger 1121 and a temperature of a refrigerant in the second indoor heat exchanger 1122 are the same, a temperature difference of the airflow when passing through the first indoor heat exchanger 1121 is greater than a temperature difference of the airflow when passing through the second indoor heat exchanger 1122. In this way, the temperature change of the refrigerant in the second indoor heat exchanger 1122 is small, which results in the reduction of the sub-cooling degree of the refrigerant flowing through the indoor unit 11 and the decrease in the heating capacity of the air conditioner 10. In addition, the first indoor heat exchanger 1121 and the second indoor heat exchanger 1122 are sequentially disposed in the air-outlet direction of the indoor fan 111 (e.g., a front-rear direction), which will increase the wind resistance of the indoor unit 11 and result in an increase in energy consumption of the air conditioner 10.

Figure 2:
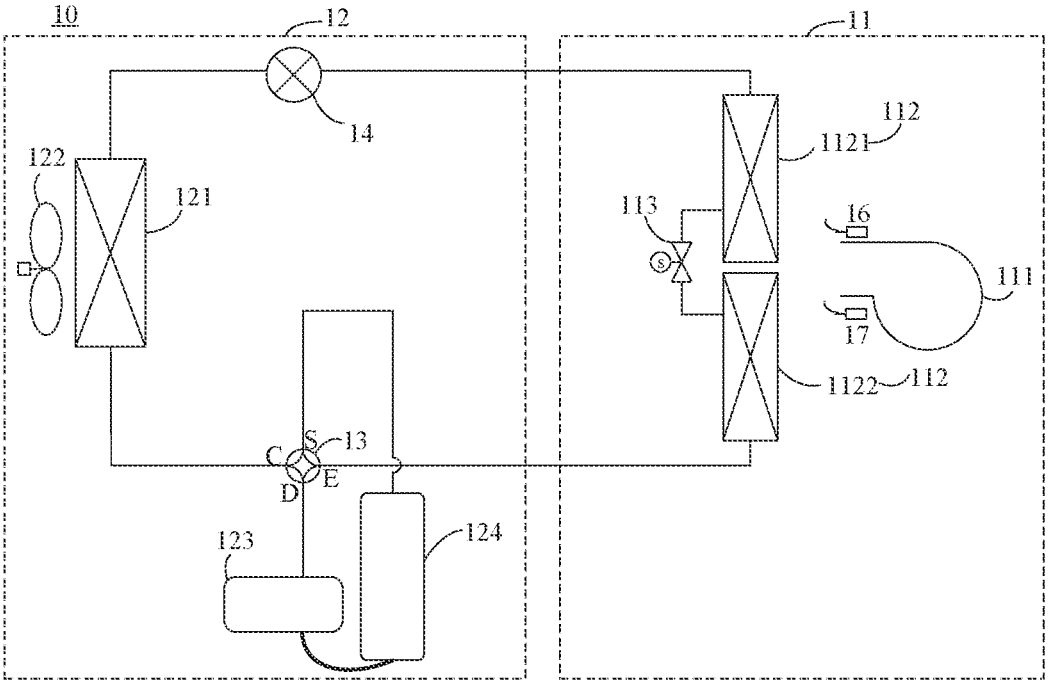
FIG. 2 is a structural diagram of another air conditioner, in accordance with some embodiments.

FIG. 2 is a structural diagram of another air conditioner, in accordance with some embodiments. As shown in FIG. 2, some embodiments of the present disclosure provide another air conditioner 10, and the main difference between the air conditioner in FIG. 2 and the air conditioner in FIG. 1 is that the first indoor heat exchanger 1121 and the second indoor heat exchanger 1122 in FIG. 2 are disposed in sequence perpendicular to the air-outlet direction of the indoor fan 111.

In this way, a part of the airflow blown by the indoor fan 111 passes through the first indoor heat exchanger 1121, and another part of the airflow passes through the second indoor heat exchanger 1122, which reduces the wind resistance of the indoor unit 111 and reduces the energy consumption of the air conditioner 10.

FIG. 2 considers an example in which a surface of the first indoor heat exchanger 1121 proximate to the indoor fan 111 is substantially coplanar with a surface of the second indoor heat exchanger 1122 proximate to the indoor fan 111, but the present disclosure is not limited thereto. In some embodiments of the present disclosure, ends of the first indoor heat exchanger 1121 and the second indoor heat exchanger 1122 that are proximate to each other abut against each other. In this case, an included angle between the first indoor heat exchanger 1121 and the second indoor heat exchanger 1122 may also be an acute angle or an obtuse angle. In some embodiments of the present disclosure, the ends of the first indoor heat exchanger 1121 and the second indoor heat exchanger 1122 that are proximate to each other may also be connected through pipelines.

Figure 3A:
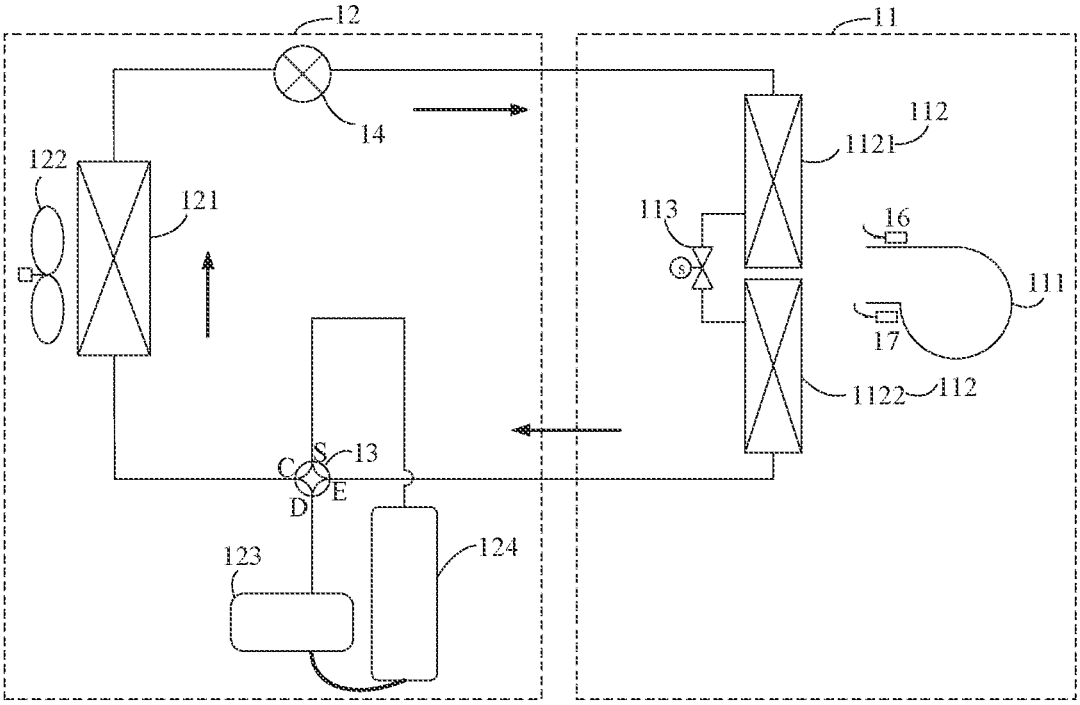
FIG. 3A is a schematic diagram showing a flow direction of a refrigerant of an air conditioner, in accordance with some embodiments.

FIG. 3A is a schematic diagram showing a flow direction of a refrigerant of an air conditioner, in accordance with some embodiments. As shown in FIG. 3A, in a case where the air conditioner 10 operates in the cooling mode, the dehumidification solenoid valve 113 is in a turn-on state, and the four-way valve 13 is in a first state, that is, a D end of the four-way valve 13 is connected to a C end, and an E end is connected to an S end. In this case, the outdoor heat exchanger 121 operates as a condenser, and both the first indoor heat exchanger 1121 and the second indoor heat exchanger 1122 operate as evaporators.

The compressor 123 compresses a gas-phase refrigerant with a low temperature and a low pressure and discharges a compressed gas-phase refrigerant with a high temperature and a high pressure, and the gas-phase refrigerant with the high temperature and the high pressure flows into the outdoor heat exchanger 121. The outdoor heat exchanger 121 condenses the gas-phase refrigerant with the high temperature and the high pressure into a liquid-phase refrigerant with a high pressure, and the heat in the refrigerant is released to the surrounding environment during the condensation process. The expansion valve 14 expands the liquid-phase refrigerant with the high pressure into a gas-liquid two-phase refrigerant with a low pressure. The first indoor heat exchanger 1121 and the second indoor heat exchanger 1122 absorb heat from the surrounding environment and evaporate the gas-liquid two-phase refrigerant with the low pressure to form the gas-phase refrigerant with the low temperature and the low pressure. The gas-phase refrigerant with the low temperature and the low pressure returns to the compressor 123, so as to form a refrigeration cycle.

In the case where the air conditioner 10 operates in the reheat dehumidification mode, the dehumidification solenoid valve 113 is in a turn-off state, and the four-way valve 13 is in the first state. In this case, the outdoor heat exchanger 121 operates as a condenser, the first indoor heat exchanger 1121 operates as a condenser, and the second indoor heat exchanger 1122 operates as an evaporator.

The compressor 123 compresses the gas-phase refrigerant with the low temperature and the low pressure and discharges the compressed gas-phase refrigerant with the high temperature and the high pressure, and the gas-phase refrigerant with the high temperature and the high pressure flows into the outdoor heat exchanger 121. The outdoor heat exchanger 121 condenses the gas-phase refrigerant with the high temperature and the high pressure into the liquid-phase refrigerant with the high pressure, and the heat in the refrigerant is released to the surrounding environment during the condensation process. The expansion valve 14 expands the liquid-phase refrigerant with the high pressure into the gas-liquid two-phase refrigerant with the low pressure. The first indoor heat exchanger 1121 further condenses the gas-liquid two-phase refrigerant into a liquid-phase refrigerant with a low pressure, and the heat in the refrigerant is released to the surrounding environment during the condensation process. The second indoor heat exchanger 1122 absorbs heat from the surrounding environment and evaporates the liquid-phase refrigerant with the low pressure to form the gas-phase refrigerant with the low temperature and the low pressure. The gas-phase refrigerant with the low temperature and the low pressure returns to the compressor 123. A first part of the airflow blown by the indoor fan 111 is heated up when passing through the first indoor heat exchanger 1121, and a second part of the airflow is cooled down and dehumidified when passing through the second indoor heat exchanger 1122. The two parts of the airflow are mixed and blown indoors, so that the humidity of the indoor air will be reduced, and the temperature will not be reduced.

Figure 3B:
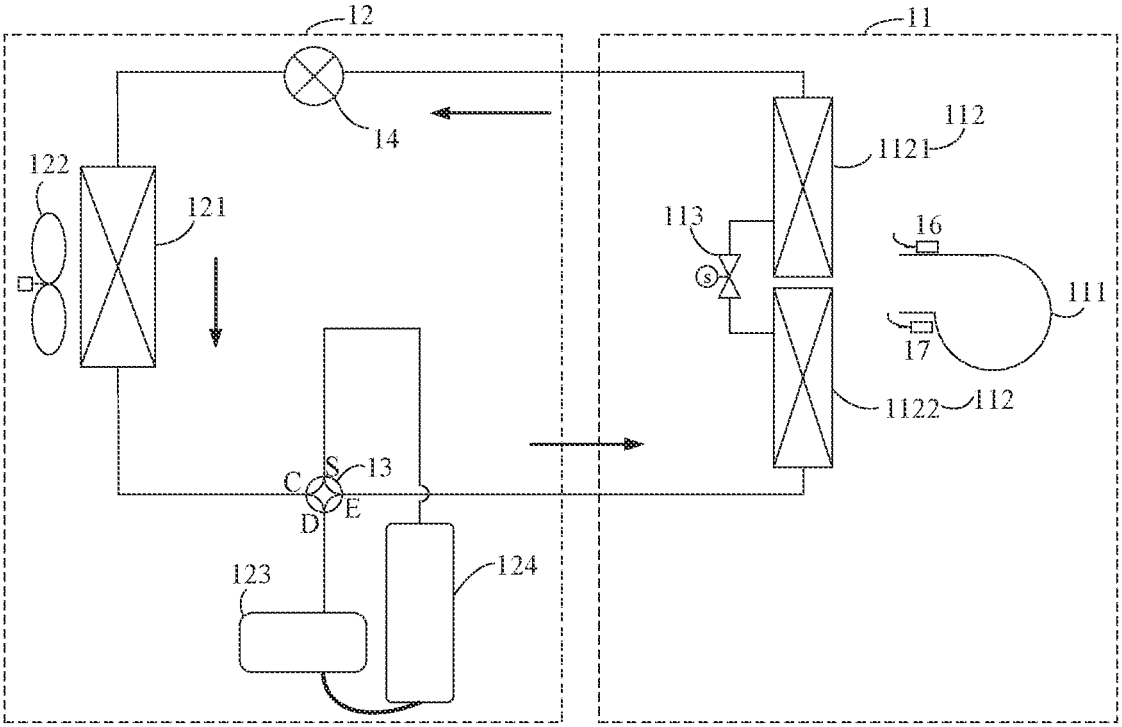
FIG. 3B is a schematic diagram showing another flow direction of a refrigerant of an air conditioner, in accordance with some embodiments.

FIG. 3B is a schematic diagram showing another flow direction of a refrigerant of an air conditioner, in accordance with some embodiments. As shown in FIG. 3B, in the case where the air conditioner 10 operates in the heating mode, the dehumidification solenoid valve 113 is in the turn-on state, and the four-way valve 13 is in a second state, that is, the D end of the four-way valve 13 is connected to the E end, and the C end is connected to the S end. In this case, the outdoor heat exchanger 121 operates as an evaporator, and both the first indoor heat exchanger 1121 and the second indoor heat exchanger 1122 operate as condensers.

The compressor 123 compresses the gas-phase refrigerant with the low temperature and the low pressure and discharges the compressed gas-phase refrigerant with the high temperature and the high pressure. The gas-phase refrigerant with the high temperature and the high pressure flows into the first indoor heat exchanger 1121 and the second indoor heat exchanger 1122. Both the first indoor heat exchanger 1121 and the second indoor heat exchanger 1122 operate as the condensers, so as to condense the gas-phase refrigerant with the high temperature and the high pressure into the liquid-phase refrigerant with the high pressure, and the heat in the refrigerant is released to the surrounding environment during the condensation process. The expansion valve 14 expands the liquid-phase refrigerant with the high pressure into a gas-liquid two-phase refrigerant with a low pressure. The outdoor heat exchanger 121 absorbs heat from the surrounding environment and evaporates the gas-liquid two-phase refrigerant with the low pressure to form the gas-phase refrigerant with the low temperature and the low pressure. The gas-phase refrigerant with the low temperature and the low pressure returns to the compressor 123 to form a heating cycle.

The air conditioner 10 further includes a temperature sensor 16 and a humidity sensor 17. The temperature sensor 16 is disposed at an air inlet of the indoor unit 11 and is configured to detect indoor air temperature. The humidity sensor 17 is disposed at the air inlet of the indoor unit 11 and is configured to detect indoor air humidity. In some embodiments of the present disclosure, the temperature sensor 16 and the humidity sensor 17 may be integrated into one sensor.

In the related art, when the air conditioner 10 receives an instruction to operate the reheat dehumidification mode, the air conditioner 10 will first operate the cooling mode to reduce the indoor temperature to a target temperature set by the user and then operate the reheat dehumidification mode. The indoor temperature will further decrease in a case where the air conditioner 10 operates in the reheat dehumidification mode. Therefore, the above control method may cause the indoor temperature to be lower than a target temperature, thereby affecting user comfort and increasing energy consumption of the air conditioner 10.

In order to solve the above problem, some embodiments of the present disclosure provide a control method of the air conditioner 10, which is applied to the controller 15. The air conditioner 10 may operate the reheat dehumidification mode before the indoor temperature decreased to the target temperature by using the control method of some embodiments of the present disclosure, so as to prevent the indoor temperature from decreasing below the target temperature and exceeding a threshold temperature in a case where the air conditioner 10 operates in the reheat dehumidification mode, which ensures the user comfort and may reduce the energy consumption of the air conditioner 10.

It will be noted that the control method of the air conditioner 10 provided by some embodiments of the present disclosure may be applied to an air conditioner which has the reheat dehumidification mode, such as the air conditioner shown in FIG. 1 or FIG. 2. The present disclosure does not limit the structure and the model of the air conditioner which has the reheat dehumidification mode.

Figure 4:
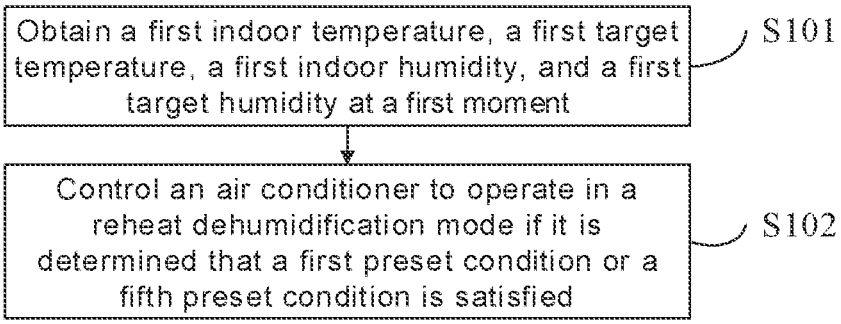
FIG. 4 is a flow diagram of a control method of an air conditioner, in accordance with some embodiments.

FIG. 4 is a flow diagram of a control method of an air conditioner, in accordance with some embodiments. As shown in FIG. 4, in some embodiments of the present disclosure, the control method includes steps S101 to S102.

In step S101, a first indoor temperature Ti1 and a first target temperature Ts1 are obtained at a first moment.

It will be noted that the first moment is a moment when the controller 15 receives an instruction from the user for instructing the air conditioner 10 to operate the reheat dehumidification mode. Alternatively, the first moment is a moment after the controller 15 receives the instruction from the user for instructing the air conditioner 10 to operate the reheat dehumidification mode.

The target temperature Ts is a temperature that the user expects the indoor environment to achieve. For example, when the user instructs the air conditioner 10 to operate the reheat dehumidification mode, the target temperature Ts may be set by using a remote control or a panel of the air conditioner 10. The first target temperature Ts1 is a target temperature at the first moment.

The first indoor temperature Ti1 is an actual temperature of the indoor air at the first moment and is measured by the temperature sensor 16.

Of course, the present disclosure is not limited thereto. In some embodiments of the present disclosure, the controller 15 may further obtain the first indoor temperature Ti1, the first target temperature Ts1, a first indoor humidity Hi1, and a first target humidity Hs1 at the first moment.

The target humidity Hs is a humidity that the user expects the indoor environment to achieve. For example, when the user instructs the air conditioner 10 to operate the reheat dehumidification mode, the target humidity Hs may be set by using the remote control or the panel of the air conditioner 10. The first target humidity Hs1 is a target humidity of the air conditioner 10 at the first moment.

The first indoor humidity Hi1 is an actual indoor humidity at the first moment and is measured by the humidity sensor 17.

In some embodiments of the present disclosure, the air conditioner 10 is in a standby state or operates in the cooling mode before the controller 15 receives the instruction from the user for instructing the air conditioner 10 to operate the reheat dehumidification mode, the present disclosure is not limited thereto.

In step S102, if it is determined that a first preset condition is satisfied, the air conditioner 10 is controlled to operate in the reheat dehumidification mode.

In some embodiments of the present disclosure, the first preset condition includes that the first indoor temperature Ti1 is less than or equal to a sum of the first target temperature Ts1 and the first preset temperature dTs1, and the first indoor temperature Ti1 is greater than the first target temperature Ts1.

In some embodiments of the present disclosure, the controller 15 controls the air conditioner 10 to operate the reheat dehumidification mode in a case where the indoor humidity is high, and the air conditioner 10 does not operate the reheat dehumidification mode in a case where the indoor humidity is low, so as to reduce the energy consumption of the air conditioner 10. Therefore, the first preset condition may further include that the first indoor humidity Hi1 is greater than or equal to a difference between the first target humidity Hs1 and a first preset humidity dHs1.

In some embodiments, after step S101, the control method further includes step S102'.

In step S102', if it is determined that a fifth preset condition is satisfied, the air conditioner 10 is controlled to operate in the reheat dehumidification mode.

The fifth preset condition includes that the first indoor temperature Ti1 is less than or equal to a sum of the first target temperature Ts1 and the first preset temperature dTs1, and the first indoor temperature Ti1 is greater than the first target temperature Ts1, and the first indoor humidity Hi1 is greater than or equal to a difference between the first target humidity Hs1 and a first preset humidity dHs1.

In some embodiments of the present disclosure, the first preset temperature dTs1 and the first preset humidity dHs1 are constants, and the first preset temperature dTs1 and the first preset humidity dHs1 may be determined and preset through experiments or computer simulations, and the present disclosure is not limited thereto.

If it is determined that the first preset condition is satisfied, the controller 15 controls the air conditioner 10 to operate in the reheat dehumidification mode.

In some embodiments of the present disclosure, the air conditioner 10 operates in the reheat dehumidification mode before the indoor temperature Ti reaches the target temperature Ts, so as to avoid that in a case where the air conditioner 10 operates in the reheat dehumidification mode, the indoor temperature Ti is lower than the target temperature Ts and exceeds the threshold temperature, which ensures the comfort of the user and reduces the energy consumption of the air conditioner 10.

Figure 5:
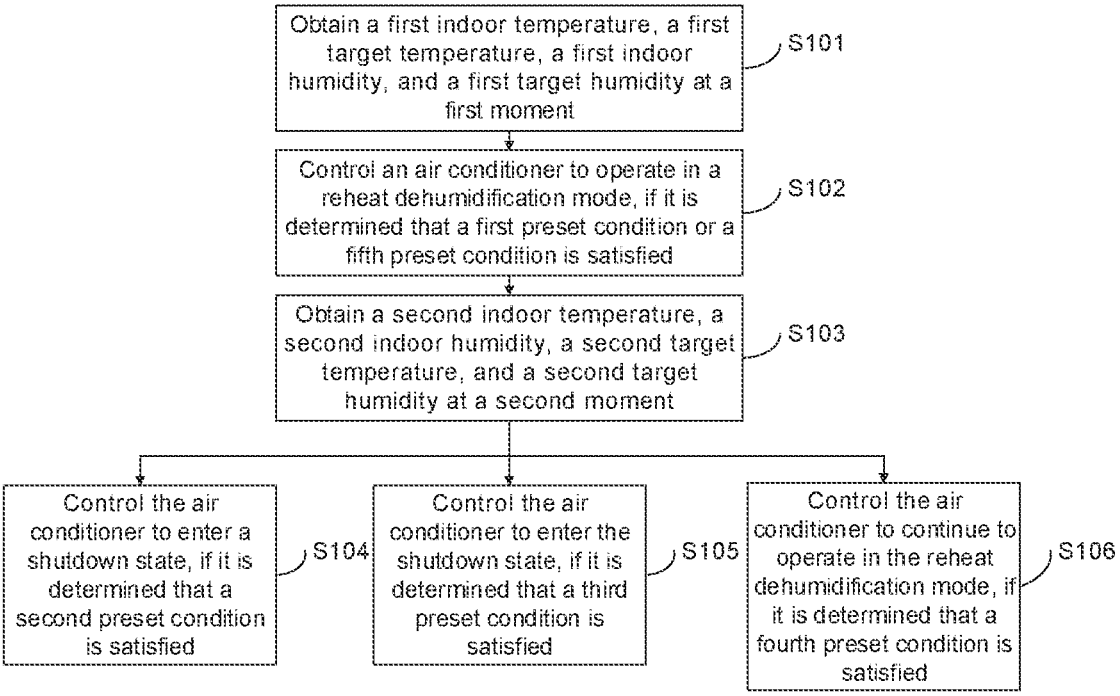
FIG. 5 is a flow diagram of another control method of an air conditioner, in accordance with some embodiments.

FIG. 5 is a flow diagram of another control method of an air conditioner, in accordance with some embodiments. As shown in FIG. 5, in some embodiments of the present disclosure, after step S102, the control method of the air conditioner 10 may further include steps S103 to S106.

In step S103, a second indoor temperature Ti2, a second indoor humidity Hi2, a second target temperature Ts2, and a second target humidity Hs2 are obtained at a second moment.

It will be noted that the second moment is a moment after the first moment, and the air conditioner 10 is still operating in the reheat dehumidification mode at the second moment.

The second indoor temperature Ti2 is a temperature of the indoor air at the second moment and is measured by the temperature sensor 16. The second indoor humidity Hi2 is a humidity of the indoor air at the second moment and is measured by the humidity sensor 17.

The second target temperature Ts2 is a target temperature at the second moment, and the second target humidity Hs2 is a target humidity at the second moment.

The controller 15 obtains the second indoor temperature Ti2, the second indoor humidity Hi2, the second target temperature Ts2, and the second target humidity Hs2 at the second moment.

In step S104, if it is determined that the second preset condition is satisfied, the air conditioner is controlled to enter a shutdown state.

The second preset condition includes that the second indoor temperature Ti2 is outside a temperature range from (Ts2−dTs2) to (Ts2+dTs2), that is, the second indoor temperature Ti2 is outside the temperature range [Ts2−dTs2, Ts2+dTs2].

An upper limit value of the temperature range is equal to a sum of the second target temperature Ts2 and the second preset temperature dTs2 (i.e., Ts2+dTs2). A lower limit value of the temperature range is equal to a difference between the second target temperature Ts2 and the second preset temperature dTs2 (i.e., Ts2-dTs2).

It will be noted that the second preset temperature dTs2 is a constant, which represents a fluctuation value of the target temperature Ts. The second preset temperature dTs2 may be preset.

The controller 15 controls the air conditioner 10 to enter the shutdown state, that is, the controller 15 controls the compressor 123 of the air conditioner 10 to stop operating, and the indoor fan 111 and the outdoor fan 122 of the air conditioner 10 also stop operating. In this case, the air conditioner 10 stops supplying air.

In step S105, if it is determined that the third preset condition is satisfied, the air conditioner 10 is controlled to enter the shutdown state.

The third preset condition includes that the second indoor temperature Ti2 is within the temperature range [Ts2−dTs2, Ts2+dTs2], and the second indoor humidity Hi2 is less than or equal to a difference between the second target humidity Hs2 and the first preset humidity dHs1.

The controller 15 controls the air conditioner 10 to enter the shutdown state in a case where one of the second preset condition and the third preset condition is satisfied, which not only satisfies requirements of the user for temperature and humidity but also reduces the energy consumption of the air conditioner 10.

In step S106, if it is determined that a fourth preset condition is satisfied, the air conditioner 10 is controlled to operate in the reheat dehumidification mode.

The fourth preset condition includes that the second indoor temperature Ti2 is within the temperature range [Ts2-dTs2, Ts2+dTs2], and the second indoor humidity Hi2 is greater than a sum of the second target humidity Hs2 and the first preset humidity dHs1.

Some embodiments of the present disclosure will be described in detail below with reference to the accompanying drawings.

In some embodiments, the air conditioner 10 receives the instruction from the user for instructing the air conditioner 10 to operate in the reheat dehumidification mode when being turned on.

Figure 6:
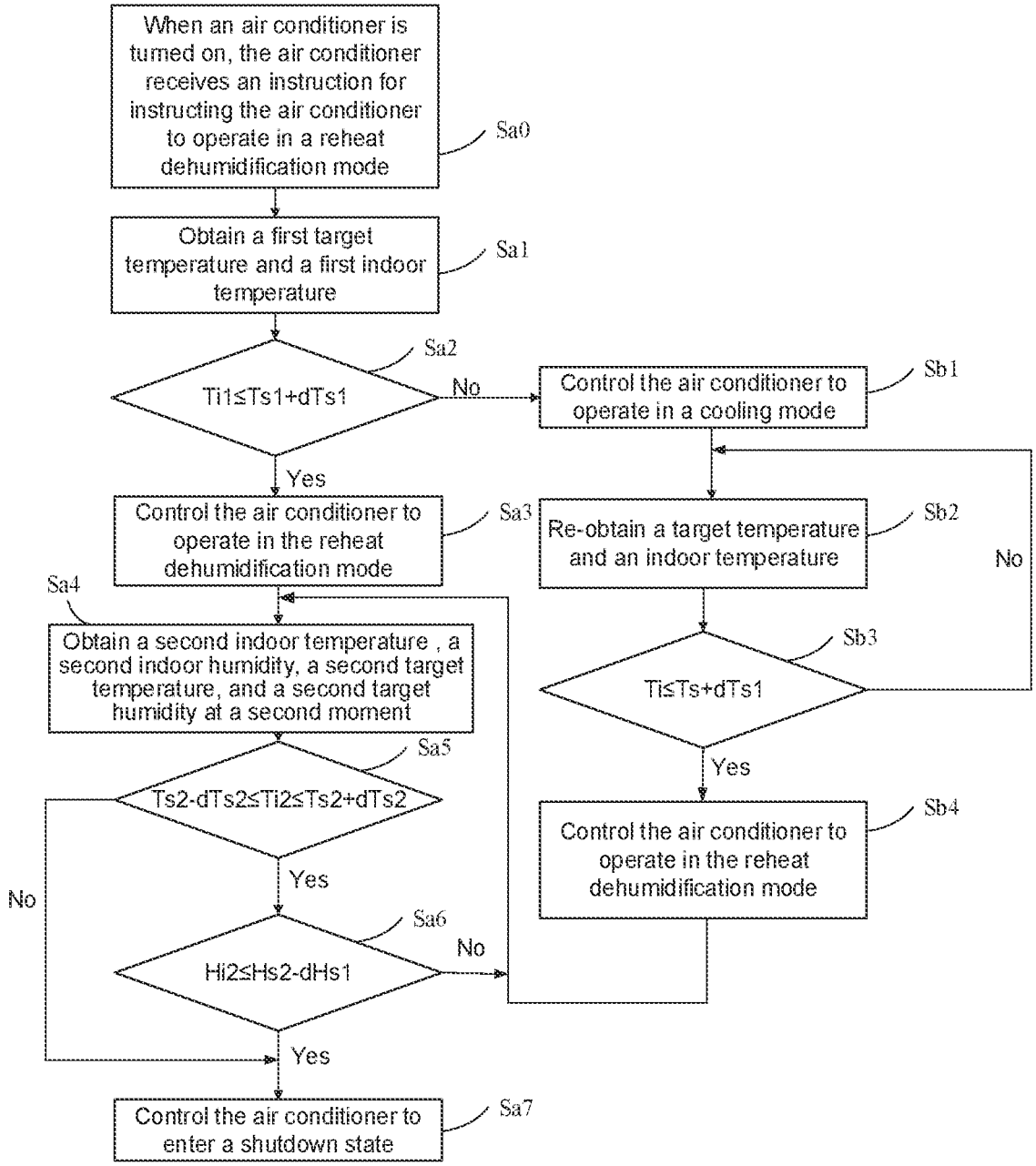
FIG. 6 is a flow diagram of yet another control method of an air conditioner, in accordance with some embodiments.

FIG. 6 is a flow diagram of yet another control method of an air conditioner, in accordance with some embodiments. As shown in FIG. 6, in this case, the control method includes steps Sa0 to Sb4.

In step Sa0, when the air conditioner 10 is turned on, the instruction for instructing the air conditioner 10 to operate in the reheat dehumidification mode is received.

In step Sa1, the first target temperature Ts1, the first target humidity Hs1, the first indoor temperature Ti1 and the first indoor humidity Hi1 are obtained.

In step Sa2, it is determined whether the first indoor temperature Ti1 is less than or equal to the sum of the first target temperature Ts1 and the first preset temperature dTs1. If so, step Sa3 is performed; if not, step Sb1 is performed.

It will be noted that after the air conditioner 10 is turned on, the first indoor temperature Ti1 is greater than the first target temperature Ts1 by default.

In step Sa3, the air conditioner 10 is controlled to operate in the reheat dehumidification mode.

In step Sa4, the second indoor temperature Ti2, the second indoor humidity Hi2, the second target temperature Ts2, and the second target humidity Hs2 are obtained at the second moment.

In step Sa5, it is determined whether the second indoor temperature Ti2 is within the temperature range [Ts2−dTs2, Ts2+dTs2]. If so, step Sa6 is performed; if not, step Sa7 is performed.

In step Sa6, it is determined whether the second indoor humidity Hi2 is less than or equal to the difference between the second target humidity Hs2 and the first preset humidity dHs1. If so, step Sa7 is performed; if not, step Sa4 is re-performed.

In step Sa7, the air conditioner 10 is controlled to enter the shutdown state.

In step Sb1, the air conditioner 10 is controlled to operate in the cooling mode.

In step Sb2, the target temperature Ts, the target humidity Hs, the indoor temperature Ti, and the indoor humidity Hi are re-obtained.

In step Sb3, it is determined whether the indoor temperature Ti is less than or equal to a sum of the target temperature Ts and the first preset temperature dTs1. If so, step Sb4 is performed; if not, step Sb2 is re-performed.

In step Sb4, the air conditioner 10 is controlled to operate in the reheat dehumidification mode.

After the air conditioner 10 operates in the reheat dehumidification mode, step Sa4 may be continued to be performed.

The present disclosure is not limited thereto. In some embodiments, it may also be that the air conditioner, while in the cooling mode, receives the instruction from the user for instructing the air conditioner to enter the reheat dehumidification mode.

Figure 7:
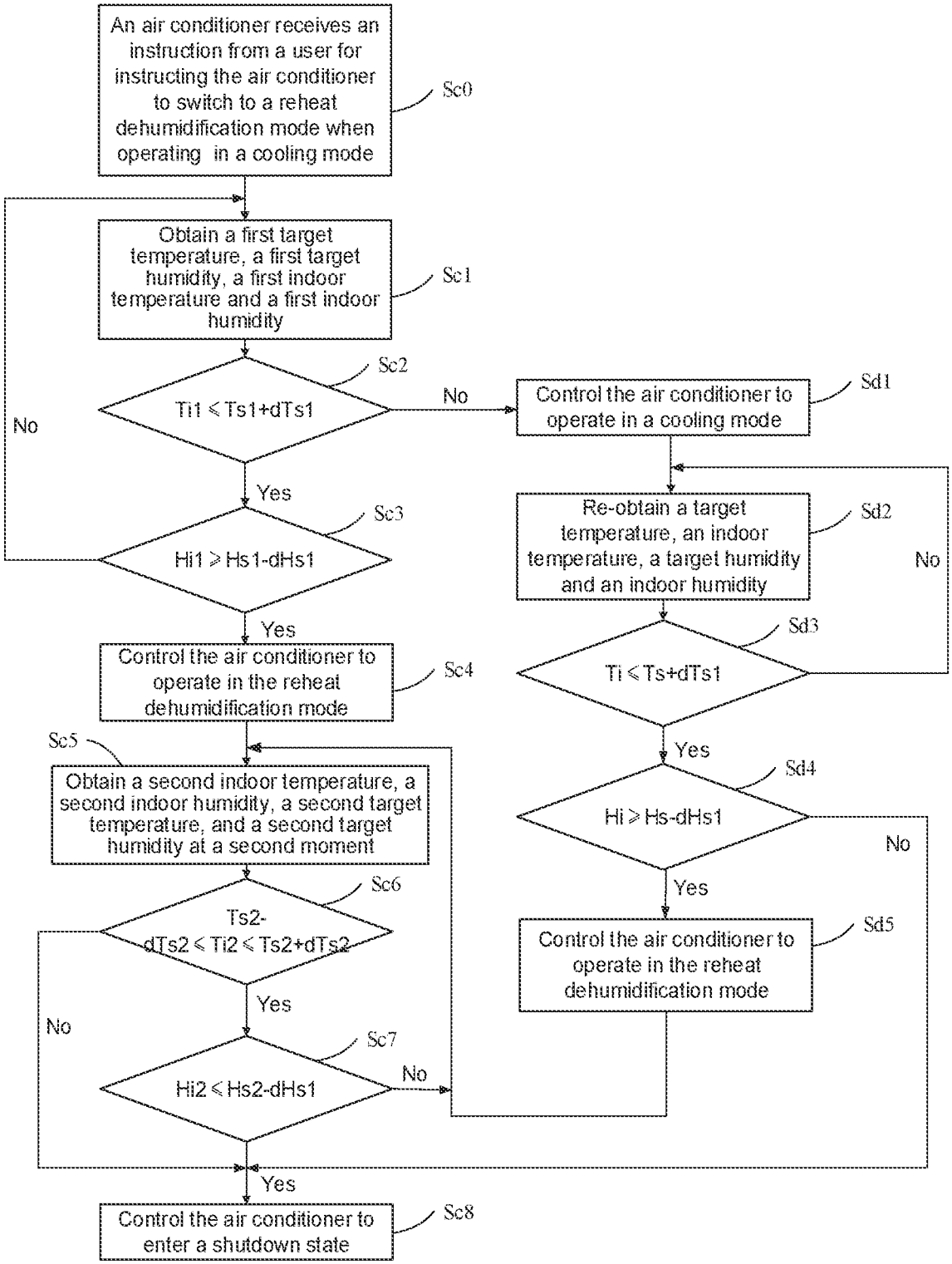
FIG. 7 is a flow diagram of yet another control method of an air conditioner, in accordance with some embodiments.

FIG. 7 is a flow diagram of yet another control method of an air conditioner, in accordance with some embodiments. As shown in FIG. 7, the control method includes steps Sc0 to Sd5.

In step Sc0, the air conditioner 10 receives the instruction from the user for instructing the air conditioner 10 to switch to the reheat dehumidification mode when operating in the cooling mode.

In step Sc1, the first target temperature Ts1, the first indoor temperature Ti1, the first target humidity Hs1, and the first indoor humidity Hi1 are obtained.

In step Sc2, it is determined whether the first indoor temperature Ti1 is less than or equal to the sum of the first target temperature Ts1 and the first preset temperature dTs1. If so, step Sc3 is performed; if not, step Sd1 is performed.

It will be noted that, in a case where the air conditioner 10 operates in the cooling mode, the first indoor temperature Ti1 is greater than the first target temperature Ts1 by default.

In step Sc3, it is determined whether the first indoor humidity Hi1 is greater than or equal to the difference between the first target humidity Hs1 and the first preset humidity dHs1. If so, step Sc4 is performed; if not, step Sc1 is re-performed.

In step Sc4, the air conditioner 10 is controlled to operate in the reheat dehumidification mode.

In step Sc5, the second indoor temperature Ti2, the second indoor humidity Hi2, the second target temperature Ts2, and the second target humidity Hs2 are obtained at the second moment.

In step Sc6, it is determined whether the second indoor temperature Ti2 is within the temperature range [Ts2−dTs2, Ts2+dTs2]. If so, step Sc7 is performed; if not, step Sc8 is performed.

In step Sc7, it is determined whether the second indoor humidity Hi2 is less than or equal to the difference between the second target humidity Hs2 and the first preset humidity dHs1. If so, step Sc8 is performed; if not, step Sc5 is re-performed.

In step Sc8, the air conditioner 10 is controlled to enter the shutdown state.

In step Sd1, the air conditioner 10 is controlled to continue to operate in the cooling mode.

In step Sd2, the target temperature Ts, the indoor temperature Ti, the target humidity Hs, and the indoor humidity Hi are re-obtained.

In step Sd3, it is determined whether the indoor temperature Ti is less than or equal to the sum of the target temperature Ts and the first preset temperature dTs1. If so, step Sd4 is performed; if not, step Sd2 is re-performed.

In step Sd4, it is determined whether the indoor humidity Hi is greater than or equal to the difference between the target humidity Hs and the first preset humidity dHs1. If so, step Sd5 is performed; if not, step Sc8 is performed.

In step Sd5, the air conditioner 10 is controlled to operate in the reheat dehumidification mode.

After the air conditioner 10 operates in the reheat dehumidification mode, step Sc5 may be continued to be performed.

Figure 8:
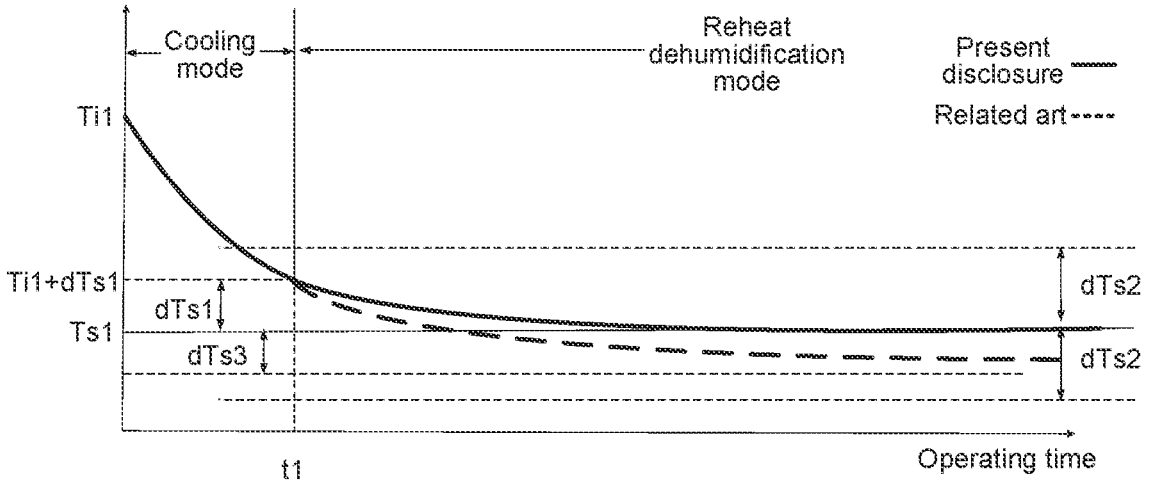
FIG. 8 is a diagram showing a temperature change switching from a cooling mode to a reheat dehumidification mode, in accordance with some embodiments.

FIG. 8 is a diagram showing a temperature change switching from a cooling mode to a reheat dehumidification mode, in accordance with some embodiments. As shown in FIG. 8, the first indoor temperature Ti1 is less than or equal to the sum of the first target temperature Ts1 and the first preset temperature dTs1 at moment t1. In this case, the controller 15 controls the air conditioner 10 to switch from the cooling mode to the reheat dehumidification mode. After the air conditioner 10 operates in the reheat dehumidification mode, as shown by the thick solid line in FIG. 8, the first indoor temperature Ti1 drops slowly, so that the first indoor temperature Ti1 may be close to the first target temperature Ts1.

Figure 9:
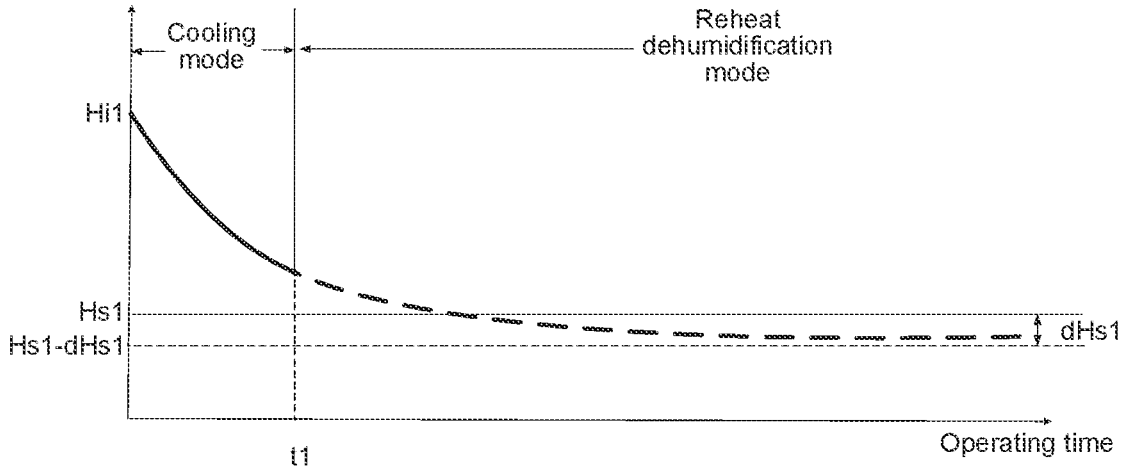
FIG. 9 is a diagram showing a humidity change switching from a cooling mode to a reheat dehumidification mode, in accordance with some embodiments.

FIG. 9 is a diagram showing a humidity change switching from a cooling mode to a reheat dehumidification mode, in accordance with some embodiments. As shown in FIG. 9, at the moment t1, the air conditioner 10 switches from the cooling mode to the reheat dehumidification mode. After the air conditioner 10 operates in the reheat dehumidification mode, the first indoor humidity Hi1 continues to decrease, so that the first indoor humidity Hi1 is close to the difference between the first target humidity Hs1 and the first preset humidity dHs1 (i.e., Hs1−dHs1).

In some embodiments of the present disclosure, the process of the air conditioner 10 operating in the reheat dehumidification mode after the air conditioner 10 is turned on may include a temperature range determination stage, an action guarantee stage, an initial control stage, and a normal control stage.

In order to enable those skilled in the art to understand the embodiments of the present disclosure more clearly, the process of the air conditioner 10 operating in the reheat dehumidification mode after the air conditioner 10 is turned on will be described in detail below.

Figure 10:
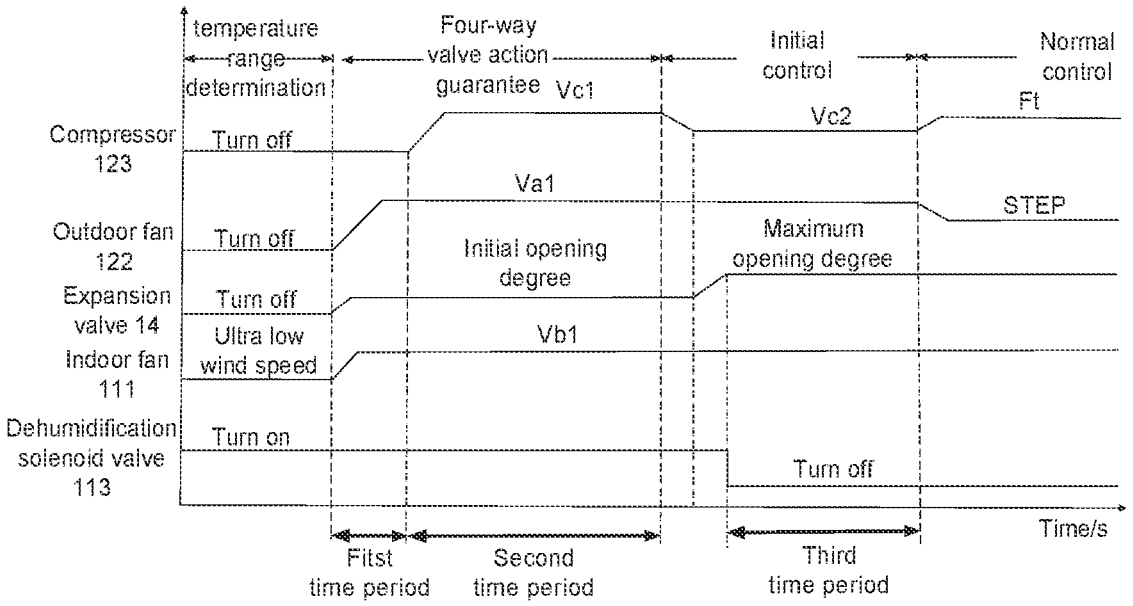
FIG. 10 is a diagram showing a process of an air conditioner entering a reheat dehumidification mode after turning on, in accordance with some embodiments.

FIG. 10 is a diagram showing a process of an air conditioner entering a reheat dehumidification mode after turning on, in accordance with some embodiments. As shown in FIG. 10, the process includes the temperature range determination stage, the action guarantee stage, the initial control stage, and the normal control stage.

<Temperature Range Determination Stage>

The air conditioner 10 receives the instruction from the user for instructing the air conditioner 10 to operate in the reheat dehumidification mode after the air conditioner 10 is turned on. The air conditioner 10 enters the temperature range determination stage in response to the instruction of the user for instructing the air conditioner 10 to operate in the reheat dehumidification mode. In the temperature range determination stage, the controller 15 controls the compressor 123 and the outdoor fan 122 to stop, controls the expansion valve 14 to be in the turn-off state, controls the dehumidification solenoid valve 113 to be in the turn-on state, and controls the indoor fan 111 to operate at a rotational speed lower than a predetermined rotational speed.

The air conditioner 10 will enter the action guarantee stage after obtaining the target temperature Ts and the target humidity Hs.

<Action Guarantee Stage>

In the action guarantee stage, the controller 15 controls the four-way valve 13 to be in the first state, an opening degree of the expansion valve 14 is a preset initial opening degree, and the dehumidification solenoid valve 113 is in the turn-on state, so that the refrigerant in the air conditioner 10 may undergo a reheat dehumidification cycle.

The controller 15 controls the outdoor fan 122 to operate at a first rotational speed Va1. The first rotational speed Va1 is a fixed value, which is related to the ambient temperature and determined according to the outdoor temperature.

The controller 15 controls the indoor fan 111 to operate at the second rotational speed Vb1 The second rotational speed Vb1 is determined according to a windshield value preset by the user, and the second rotational speed Vb1 is equal to a rotational speed corresponding to the windshield value preset by the user.

The action guarantee stage may be divided into two time periods. During a first time period as shown in FIG. 10, the controller 15 controls the compressor 123 to stop. During a second time period as shown in FIG. 10, the controller 15 controls the compressor 123 to operate at a third rotational speed Vc1.

<Initial Control Stage>

In the initial control stage, the controller 15 controls the rotational speed of the compressor 123 to switch from the third rotational speed Vc1 to a fourth rotational speed Vc2, the rotational speed of the outdoor fan 122 maintains at the first rotational speed Va1, and the rotational speed of the indoor fan 111 maintains at the second rotational speed Vb1. In a time period (i.e., a third time period in FIG. 10) after the initial control stage, the controller 15 controls the expansion valve 14 to be in a fully open state (that is, the opening degree of the expansion valve 14 is at a maximum value), and the dehumidification solenoid valve 113 is switched to the turn-off state. In this case, the air conditioner 10 implements the functions of reheating and dehumidification.

<Normal Control Stage>

In the normal control stage, the controller 15 controls the expansion valve 14 to be in the fully open state and controls the dehumidification solenoid valve 113 to be in the turn-off state, and the rotational speed of the indoor fan 111 maintains the second rotational speed Vb1.

In the normal control stage, the controller 15 may adjust the indoor temperature Ti by adjusting the rotational speed of the compressor 123, so as to make the indoor temperature Ti close to the target temperature Ts. In addition, the controller 15 may further adjust the indoor humidity Hi, so as to make the indoor humidity Hi close to the target humidity Hs.

The controller 15 may further adjust the indoor temperature Ti by adjusting the rotational speed of the outdoor fan 122, so as to make the indoor temperature Ti close to the target temperature Ts.

Figure 11:
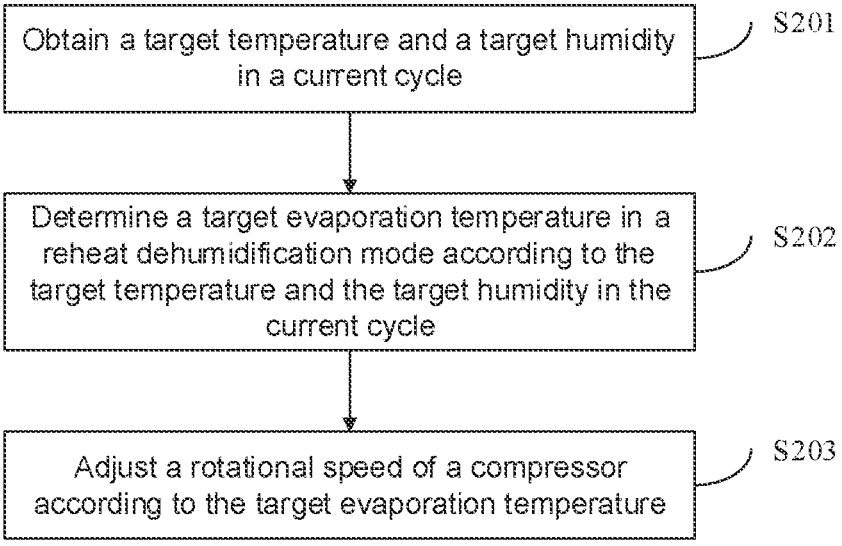
FIG. 11 is a flow diagram of yet another control method of an air conditioner, in accordance with some embodiments.

FIG. 11 is a flow diagram of yet another control method of an air conditioner, in accordance with some embodiments. As shown in FIG. 11, a method for adjusting the rotational speed of the compressor 123 includes steps S201 to S203.

In step S201, a target temperature Ts and a target humidity Hs in a current cycle are obtained.

The controller 15 obtains the target temperature Ts and the target humidity Hs in the current cycle.

In step S202, a target evaporation temperature Te0 in the reheat dehumidification mode is determined according to the target temperature Ts and the target humidity Hs in the current cycle.

It will be noted that the evaporation temperature Te of the refrigerant is an evaporation critical temperature at which a liquid-phase refrigerant in the evaporator changes into a gas-phase refrigerant. In a case where the air conditioner 10 operates in the reheat dehumidification mode, the temperature of the indoor heat exchanger 112 (e.g., the first indoor heat exchanger 1121) as an evaporator is usually detected as an actual evaporation temperature of the refrigerant. The target evaporation temperature Te0 is a temperature that the indoor heat exchanger 112 as an evaporator needs to reach.

In some embodiments of the present disclosure, the target evaporation temperature Te0 may be obtained according to formula (1).

$$Te0=A\times Ts-B-dTe \quad \text{Formula (1)}$$

Where Te0 is the target evaporation temperature, Ts is the target temperature, dTe is a third preset temperature, A and B are constants determined according to the target humidity Hs.

In some embodiments of the present disclosure, the formula (1) is obtained by fitting a psychrometric chart, and A and B determined by different target humidity Hs are different constants.

For example, in a case where the target humidity Hs is equal to 40% (i.e., Hs=40%), Te0 is equal to A1×Ts−B1−dTe (i.e., Te0=A1×Ts−B1−dTe). In a case where the target humidity Hs is equal to 50% (i.e., Hs=50%), Te0 is equal to A2×Ts−B2−dTe (i.e., Te0=A2×Ts B2−dTe). In a case where the target humidity Hs is equal to 60% (i.e., Hs=60%), Te0 is equal to A3×Ts−B3−dTe (i.e., Te0=A3×Ts−B3−dTe). A1, A2, A3, B1, B2, and B3 are all constants. A1, A2, and A3 are not equal to each other, and B1, B2, and B3 are not equal to each other.

In step S203, a rotational speed Ft of the compressor 123 is adjusted according to the target evaporation temperature Te0.

It will be noted that the rotational speed Ft of the compressor 123 may be adjusted periodically.

For example, the rotational speed of the compressor 123 in the current cycle is Ft(n), and Ft(n) is obtained according to formula (2).

$$Ft(n)=Ft(n-1)+\Delta F \quad \text{Formula (2)}$$

Where Ft(n−1) represents a rotational speed of the compressor 123 in a previous cycle, and ΔF represents a rotational speed adjustment value of the compressor 123.

In some embodiments of the present disclosure, in order to ensure the normal operation of the compressor 123, the rotational speed Ft of the compressor 123 satisfies that Ft is greater than or equal to Ftmin and less than or equal to Ftmax (i.e., Ftmin≤Ft≤Ftmax). Ftmin represents a minimum value of the preset rotational speed of the compressor 123, and Ftmax represents a maximum value of the preset rotational speed of the compressor 123.

Therefore, if it is calculated that Ft(n) is greater than Ftmax (i.e., Ft(n)>Ftmax) according to formula (2), the controller 15 controls the compressor 123 to operate at Ftmax. If it is calculated that Ft(n) is less than Ftmin (i.e., Ft(n)<Ftmin), the controller 15 controls the compressor 123 to operate at Ftmin.

In some embodiments of the present disclosure, the rotational speed adjustment value ΔF of the compressor 123 is obtained according to formula (3).

$$\Delta F=Kp\times[ePs(n)-ePs(n-1)]+Ki\times ePs(n) \quad \text{Formula (3)}$$

Where Kp and Ki are both constants. ePs(n) is equal to a difference between Te(n) and Te0 (i.e., ePs(n)=Te(n)−Te0). Te(n) represents an actual temperature of the first indoor heat exchanger 1121 in the current cycle. ePs(n−1) is equal to a difference between Te(n−1) and Te0 (i.e., ePs(n−1)=Te(n−1)−Te0). Te(n−1) represents an actual temperature of the first indoor heat exchanger 1121 in the previous cycle. Usually, ePs(0) is equal to ePs(1) (i.e., ePs(0)=ePs(1)) by default.

In some embodiments of the present disclosure, in order to ensure the normal operation of the compressor 123, the rotational speed adjustment value ΔF of the compressor 123 satisfies that ΔF is greater than or equal to ΔFmin and less than or equal to ΔFmax (i.e., ΔFmin≤ΔF≤ΔFmax). ΔFmin represents a minimum value of the rotational speed adjustment value of the compressor 123, and ΔFmax represents a maximum value of the rotational speed adjustment value of the compressor 123.

Therefore, if it is calculated that ΔF is greater than ΔFmax (i.e., ΔF>ΔFmax) according to formula (3), then Ft(n) equal to a sum of Ft (n−1) and ΔFmax (i.e., Ft(n)=Ft(n−1)+ΔFmax) is determined. If it is calculated that ΔF is less than ΔFmin (i.e., ΔF<ΔFmin) according to formula (3), Ft(n) equal to a sum of Ft(n−1) and ΔFmin (i.e., Ft(n)=Ft(n−1)+ΔFmin) is determined.

In some embodiments of the present disclosure, the target evaporation temperature Te0 is determined according to the target temperature Ts and the target humidity Hs, and the temperature of the indoor heat exchanger 112 as an evaporator can reach the target evaporation temperature Te0 by continuously adjusting the rotational speed Ft of the compressor 123, so as to implement the adjustment of the indoor temperature Ti and the indoor humidity Hi.

Figure 12:
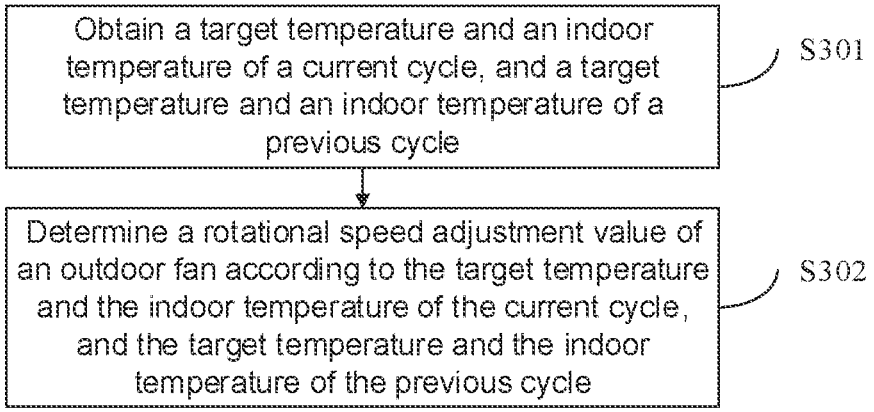
FIG. 12 is a flow diagram of yet another control method of an air conditioner, in accordance with some embodiments.

FIG. 12 is a flow diagram of yet another control method of an air conditioner, in accordance with some embodiments. As shown in FIG. 12, in some embodiments of the present disclosure, the method for adjusting the rotational speed of the outdoor fan 122 includes steps S301 to S302.

In step S301, a target temperature Ts(n) and an indoor temperature Ti(n) of the current cycle, and a target temperature Ts(n−1) and an indoor temperature Ti(n−1) of the previous cycle are obtained.

In step S302, the rotational speed adjustment value of the outdoor fan 122 is determined according to the target temperature Ts(n) and the indoor temperature Ti(n) of the current cycle, and the target temperature Ts(n−1) and the indoor temperature Ti(n−1) of the previous cycle.

The controller 15 determines the temperature change value ΔNfo according to the target temperature Ts(n) and the indoor temperature Ti(n) of the current cycle, and the target temperature Ts(n−1) and the indoor temperature Ti(n−1) of the previous cycle. Then, the controller 15 determines the rotational speed adjustment value of the outdoor fan 122 according to the temperature change value ΔNfo.

In some embodiments of the present disclosure, the temperature change value ΔNfo may be obtained according to formula (4).

$$\Delta Nfo = Kfp \times [eTi(n) - eTi(n-1)] + Kfi \times eTi(n) \quad \text{Formula (4)}$$

Where ΔNfo represents the temperature change value, Kfp and Kfi are constants, eTi(n) is equal to a difference between Ti(n) and Ts(n) (i.e., eTi (n)=Ti(n)−Ts(n)), eTi(n−1) is equal to a difference between Ti(n−1) and Ts(n−1) (i.e., eTi(n−1)=Ti (n−1)−Ts (n−1)), and eTi(0) is equal to eTi(1) (i.e., eTi(0)=eTi(1)) by default.

The rotational speed initial value of the outdoor fan 122 is the first rotational speed Va1 of the outdoor fan 122.

In some embodiments of the present disclosure, the rotational speed adjustment value of the outdoor fan 122 is represented by a rotational speed step. Table 1 shows a corresponding relationship between the rotational speed steps and the temperature change values, for example, the rotational speed step is positively correlated to the temperature change value.

TABLE 1

| Rotational speed step (STEP) | Temperature change value (° C.) |
|---|---|
| +5STEP | +100 < ΔNfo |
| +3STEP | +50 < ΔNfo ≤ +100 |
| +2STEP | +20 < ΔNfo ≤ +50 |
| +1STEP | +5 < ΔNfo ≤ +20 |
| 0 (i.e., no change) | −5 < ΔNfo ≤ +5 |
| −1STEP | −20 < ΔNfo ≤ −5 |
| −2STEP | −50 < ΔNfo ≤ −20 |
| −3STEP | −100 < ΔNfo ≤ −50 |
| −5STEP | ΔNfo ≤ −100 |

As shown in Table 1, in some embodiments of the present disclosure, in order to ensure the normal operation of the outdoor fan 122, the rotational speed step needs to satisfy that STEP is greater than or equal to STEPmin and less than or equal to STEPmax (i.e., STEPmin≤STEP≤STEPmax). STEPmin is a minimum value of the rotational speed step, and STEPmax is a maximum value of the rotational speed step.

In some embodiments of the present disclosure, the controller 15 determines the rotational speed adjustment value of the outdoor fan 122 according to the target temperature Ts(n) and the indoor temperature Ti(n) of the current cycle, and the target temperature Ts(n−1) and the indoor temperature Ti(n−1) of the previous cycle, so that the outdoor fan 122 operates at a preset rotational speed, and the indoor temperature Ti finally reaches the target temperature Ts.

Figure 13:
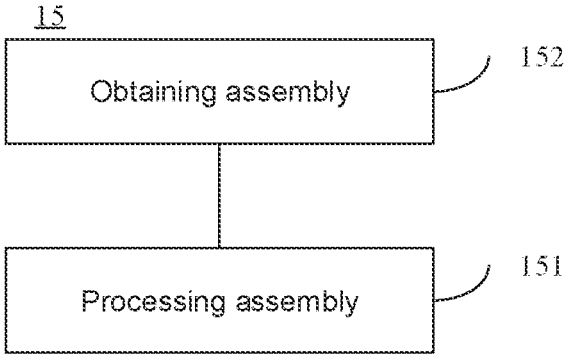
FIG. 13 is a block diagram of a controller of an air conditioner, in accordance with some embodiments.

FIG. 13 is a block diagram of a controller of an air conditioner, in accordance with some embodiments. As shown in FIG. 13, the controller 15 of the air conditioner 10 includes a processing assembly 151 and an obtaining assembly 152.

The processing assembly 151 is configured to control the air conditioner 10 to enter different operation modes in a case where different preset conditions are satisfied. For example, when it is determined that the first preset condition is satisfied, the processing assembly 151 controls the air conditioner 10 to operate in the reheat dehumidification mode. When it is determined that one of the second preset condition and the third preset condition is satisfied, the processing assembly 151 controls the air conditioner 10 to enter a shutdown mode. When it is determined that the fourth preset condition is satisfied, the processing assembly 151 controls the air conditioner 10 to operate in the reheat dehumidification mode.

The obtaining assembly 152 is configured to obtain parameters related to the above preset conditions. For example, the first indoor temperature Ti1, the first target temperature Ts1, the first target humidity Hs1, and the first indoor humidity Hi1 are obtained at the first moment. The second indoor temperature Ti2, the second indoor humidity Hi2, the second target temperature Ts2, and the second target humidity Hs2 are obtained at the second moment.

Figure 14:
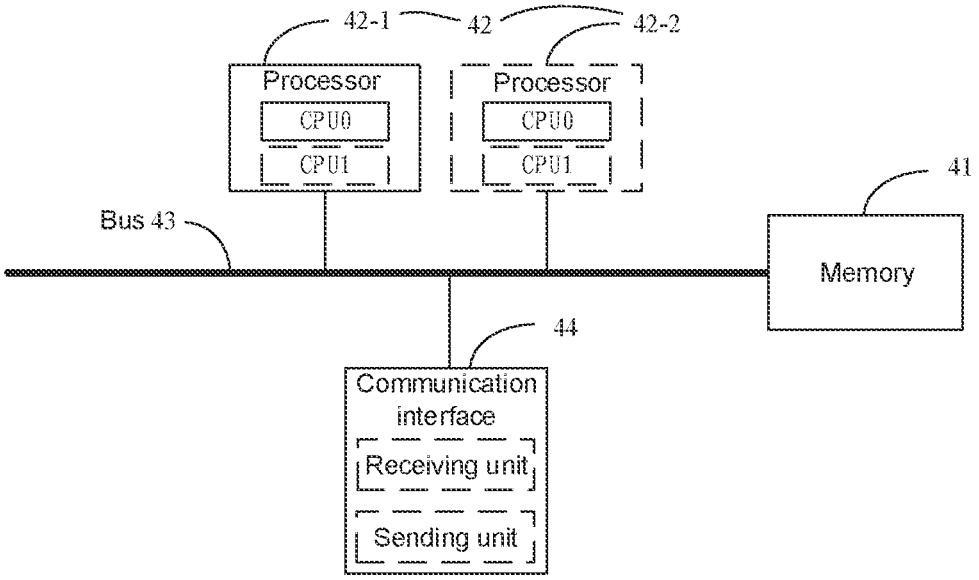
FIG. 14 is a block diagram of another controller of an air conditioner, in accordance with some embodiments.

FIG. 14 is a block diagram of another controller of an air conditioner, in accordance with some embodiments. As shown in FIG. 14, some embodiments of the present disclosure further provide another controller 40 of an air conditioner 10, and the controller 40 includes a memory 41, a processor 42, a bus 43, and a communication interface 44. The memory 41 is used to store computer executable instructions, and the processor 42 and the memory 41 are connected through the bus 43. When the controller 40 of the air conditioner 10 is operating, the processor 42 performs the computer executable instructions stored in the memory 41, so as to enable the controller 40 of the air conditioner 10 to perform the control method of the air conditioner 10 provided in the above embodiments.

In some embodiments of the present disclosure, the processor 42 (e.g., 42-1 or 42-2 shown in FIG. 14) may include one or more CPUs. For example, a CPU0 and a CPU1 shown in FIG. 14. The controller 40 of the air conditioner may include a plurality of processors 42, such as a processor 42-1 and a processor 42-2 shown in FIG. 14. Each CPU in the processor 42 may be a single-CPU or a multi-CPU, The processor 42 may refer to one or more devices, circuits, and/or processing cores for processing data (e.g., computer program instructions).

The memory 41 may be a read-only memory (ROM) or a static storage device of any other type that may store static information and instructions, a random access memory (RAM) or a dynamic storage device of any other type that may store information and instructions, an electrically erasable programmable read-only memory (EEPROM), a compact disc read-only memory (CD-ROM), or any other compact disc storage or optical disc storage (including a compact disc, a laser disc, an optical disc, a digital versatile disc or a Blue-ray disc), a magnetic disc storage medium or any other magnetic storage device, or any other medium that may be used to carry or store desired program codes in a form of instructions or data structures and that may be accessed by a computer, but is not limited thereto.

The communication interface 44 may connect multiple types of transceivers, and the communication interface 44 is used to communicate with other equipment or communication networks, such as a control system, a radio access network (RAN), or a wireless local area network (WLAN).

The communication interface 44 may include a receiving unit used to implement a receiving function and a sending unit used to implement a sending function.

The bus 43 may be an industry standard architecture (ISA) bus, a peripheral component interconnect (PCI) bus, or an extended industry standard architecture (EISA) bus. The bus 43 may be divided into an address bus, a data bus, or a control bus.

Some embodiments of the present disclosure provide a non-transitory computer-readable storage medium, and the non-transitory computer-readable storage medium includes the computer executable instructions that, when run on a computer, causes the computer to execute any one of the above methods.

Some embodiments of the present disclosure provide a computer program product including computer instructions that, when run on a computer, causes the computer to execute any one of the above methods.

A person skilled in the art will understand that the scope of disclosure in the present application is not limited to specific embodiments discussed above, and may modify and substitute some elements of the embodiments without departing from the spirits of this application. The scope of the application is limited by the appended claims.

What is claimed is:

1. An air conditioner, comprising:

an outdoor unit including a compressor configured to compress a refrigerant;

an indoor unit including an indoor fan configured to supply air indoors;

a temperature sensor configured to detect a first indoor temperature and a second indoor temperature;

a humidity sensor configured to detect a first indoor humidity and a second indoor humidity; and a controller configured to:

obtain the first indoor temperature, a first target temperature, the first indoor humidity, and a first target humidity at a first moment;

control the air conditioner to operate in a reheat dehumidification mode if determining that a fifth preset condition is satisfied; wherein the reheat dehumidification mode refers to a mode that the air conditioner heats dehumidified cold air before sending the dehumidified cold air indoors; and control the air conditioner to operate in a cooling mode if determining that the fifth preset condition is not satisfied;

the controller being further configured to:

after controlling the air conditioner to operate in the reheat dehumidification mode, obtain the second indoor temperature, the second indoor humidity, a second target temperature, and a second target humidity at a second moment; and control the air conditioner to enter a shutdown state if determining that one of a second preset condition and a third preset condition is satisfied;

wherein the fifth preset condition includes that the first indoor temperature is less than or equal to a sum of the first target temperature and a first preset temperature, the first indoor temperature is greater than the first target temperature, and the first indoor humidity is greater than or equal to a difference between the first target humidity and a first preset humidity;

the second preset condition includes that the second indoor temperature is outside a temperature range, an upper limit value of the temperature range is equal to a sum of the second target temperature and a second preset temperature, and a lower limit value of the temperature range is equal to a difference between the second target temperature and the second preset temperature; and the third preset condition includes that the second indoor temperature is within the temperature range, and the second indoor humidity is less than or equal to a difference between a second target humidity and a first preset humidity.

2. The air conditioner according to claim 1, wherein the controller is further configured to:

after controlling the air conditioner to operate in the cooling mode if determining that the fifth preset condition is not satisfied, control the air conditioner to operate in the reheat dehumidification mode if determining that a fourth preset condition is satisfied;

wherein the fourth preset condition includes that the second indoor temperature is within a temperature range, and the second indoor humidity is greater than a sum of the second target humidity and the first preset humidity.

3. The air conditioner according to claim 1, wherein the indoor unit further includes an indoor heat exchanger;

the controller is further configured to:

after controlling the air conditioner to operate in the reheat dehumidification mode if determining that the fifth preset condition is satisfied, obtain a target temperature and a target humidity in a current cycle;

determine a target evaporation temperature in the reheat dehumidification mode according to the target temperature and the target humidity in the current cycle; wherein the target evaporation temperature is a temperature that the indoor heat exchanger as an evaporator needs to reach; and adjust a rotational speed of the compressor according to the target evaporation temperature.

4. The air conditioner according to claim 3, wherein a formula for calculating the target evaporation temperature is:

$$Te0=A\times Ts-B-dTe;$$

wherein Te0 is the target evaporation temperature, Ts is the target temperature, dTe is a third preset temperature, and A and B are constants determined according to the target humidity.

5. The air conditioner according to claim 2, wherein the indoor unit further includes an indoor heat exchanger;

the controller is further configured to:

after controlling the air conditioner to operate in the reheat dehumidification mode if determining that the fifth preset condition is satisfied, obtain a target temperature and a target humidity in a current cycle;

determine a target evaporation temperature in the reheat dehumidification mode according to the target temperature and the target humidity in the current cycle; wherein the target evaporation temperature is a temperature that the indoor heat exchanger as an evaporator needs to reach; and adjust a rotational speed of the compressor according to the target evaporation temperature.

6. The air conditioner according to claim 1, wherein the outdoor unit further includes an outdoor fan and an outdoor heat exchanger;

the controller is further configured to:

after controlling the air conditioner to operate in the reheat dehumidification mode if determining that the fifth preset condition is satisfied, obtain a target temperature and an indoor temperature in a current cycle, and a target temperature and an indoor temperature in a previous cycle; and determine a rotational speed adjustment value of the outdoor fan according to the target temperature and the indoor temperature in the current cycle, and the target temperature and the indoor temperature in the previous cycle.

7. The air conditioner according to claim 2, wherein the outdoor unit further includes an outdoor fan and an outdoor heat exchanger;

the controller is further configured to:

after controlling the air conditioner to operate in the reheat dehumidification mode if determining that the fifth preset condition is satisfied, obtain a target temperature and an indoor temperature in a current cycle, and a target temperature and an indoor temperature in a previous cycle; and determine a rotational speed adjustment value of the outdoor fan according to the target temperature and the indoor temperature in the current cycle, and the target temperature and the indoor temperature in the previous cycle.

8. The air conditioner according to claim 3, wherein the outdoor unit further includes an outdoor fan and an outdoor heat exchanger;

the controller is further configured to:

after controlling the air conditioner to operate in the reheat dehumidification mode if determining that the fifth preset condition is satisfied, obtain a target temperature and an indoor temperature in a current cycle, and a target temperature and an indoor temperature in a previous cycle; and determine a rotational speed adjustment value of the outdoor fan according to the target temperature and the indoor temperature in the current cycle, and the target temperature and the indoor temperature in the previous cycle.

9. A control method of an air conditioner, applied to the air conditioner according to claim 1, wherein the control method comprises:

obtaining the first indoor temperature, a first target temperature, the first indoor humidity, and a first target humidity at a first moment;

controlling the air conditioner to operate in a reheat dehumidification mode if determining that a fifth preset condition is satisfied; wherein the reheat dehumidification mode refers to a mode that the air conditioner heats dehumidified cold air before sending the dehumidified cold air indoors; and controlling the air conditioner to operate in a cooling mode if determining that the fifth preset condition is not satisfied;

wherein the fifth preset condition includes that the first indoor temperature is less than or equal to a sum of the first target temperature and a first preset temperature, the first indoor temperature is greater than the first target temperature, and the first indoor humidity is greater than or equal to a difference between the first target humidity and a first preset humidity;

the control method further comprises:

after controlling the air conditioner to operate in the reheat dehumidification mode if determining that a fifth preset condition is satisfied, obtaining a target temperature and a target humidity in a current cycle;

determining a target evaporation temperature in the reheat dehumidification mode according to the target temperature and the target humidity in the current cycle; wherein the target evaporation temperature is a temperature that the indoor heat exchanger as an evaporator needs to reach; and adjusting a rotational speed of the compressor according to the target evaporation temperature.

10. The control method according to claim 9, wherein the control method further comprises:

after controlling the air conditioner to operate in the reheat dehumidification mode, obtaining the second indoor temperature, the second indoor humidity, a second target temperature, and a second target humidity at a second moment;

controlling the air conditioner to enter a shutdown state if determining that one of a second preset condition and a third preset condition is satisfied; and controlling the air conditioner to continue to operate in the reheat dehumidification mode if determining that a fourth preset condition is satisfied;

wherein the second preset condition includes that the second indoor temperature is outside a temperature range, an upper limit value of the temperature range is equal to a sum of the second target temperature and a second preset temperature, and a lower limit value of the temperature range is equal to a difference between the second target temperature and the second preset temperature;

the third preset condition includes that the second indoor temperature is within the temperature range, and the second indoor humidity is less than or equal to a difference between the second target humidity and the first preset humidity; and the fourth preset condition includes that the second indoor temperature is within the temperature range, and the second indoor humidity is greater than a sum of the second target humidity and the first preset humidity.

11. An air conditioner, comprising:

an outdoor unit including a compressor configured to compress a refrigerant;

an indoor unit including an indoor fan configured to supply air indoors;

a temperature sensor configured to detect a first indoor temperature and a second indoor temperature;

a humidity sensor configured to detect a first indoor humidity and a second indoor humidity; and a controller configured to:

obtain the first indoor temperature and a first target temperature at a first moment;

control the air conditioner to operate in a reheat dehumidification mode if determining that a first preset condition is satisfied; wherein the reheat dehumidification mode refers to a mode that the air conditioner heats dehumidified cold air before sending the dehumidified cold air indoors; and control the air conditioner to operate in a cooling mode if determining that the first preset condition is not satisfied;

the controller being further configured to:

after controlling the air conditioner to operate in the reheat dehumidification mode, obtain the second indoor temperature and a second target temperature at a second moment; and control the air conditioner to enter a shutdown state if determining that one of a second preset condition and a third preset condition is satisfied;

wherein the first preset condition includes that the first indoor temperature is less than or equal to a sum of the first target temperature and a first preset temperature, and the first indoor temperature is greater than the first target temperature;

the second preset condition includes that the second indoor temperature is outside a temperature range, an upper limit value of the temperature range is equal to a sum of the second target temperature and a second preset temperature, and a lower limit value of the temperature range is equal to a difference between the second target temperature and the second preset temperature; and the third preset condition includes that the second indoor temperature is within the temperature range, and the second indoor humidity is less than or equal to a difference between a second target humidity and a first preset humidity.

12. The air conditioner according to claim 11, wherein the controller is further configured to:

after controlling the air conditioner to operate in the cooling mode if determining that the first preset condition is not satisfied, control the air conditioner to operate in the reheat dehumidification mode if determining that a fourth preset condition is satisfied;

wherein the fourth preset condition includes that the second indoor temperature is within the temperature range.

13. The air conditioner according to claim 11, wherein the indoor unit further includes an indoor heat exchanger;

the controller is further configured to:

after controlling the air conditioner to operate in the reheat dehumidification mode if determining that the first preset condition is satisfied, obtain a target temperature and a target humidity in a current cycle;

determine a target evaporation temperature in the reheat dehumidification mode according to the target temperature and the target humidity in the current cycle; wherein the target evaporation temperature is a temperature that the indoor heat exchanger as an evaporator needs to reach; and adjust a rotational speed of the compressor according to the target evaporation temperature.

14. The air conditioner according to claim 13, wherein a formula for calculating the target evaporation temperature is:

$$Te0=A\times Ts-B-dTe;$$

wherein Te0 is the target evaporation temperature, Ts is the target temperature, dTe is a third preset temperature, and A and B are constants determined according to the target humidity.

15. The air conditioner according to claim 12, wherein the indoor unit further includes an indoor heat exchanger;

the controller is further configured to:

after controlling the air conditioner to operate in the reheat dehumidification mode if determining that the first preset condition is satisfied, obtain a target temperature and a target humidity in a current cycle;

determine a target evaporation temperature in the reheat dehumidification mode according to the target temperature and the target humidity in the current cycle; wherein the target evaporation temperature is a temperature that the indoor heat exchanger as an evaporator needs to reach; and adjust a rotational speed of the compressor according to the target evaporation temperature.

16. The air conditioner according to claim 11, wherein the outdoor unit further includes an outdoor fan and an outdoor heat exchanger;

the controller is further configured to:

after controlling the air conditioner to operate in the reheat dehumidification mode if determining that the first preset condition is satisfied, obtain a target temperature and an indoor temperature in a current cycle, and a target temperature and an indoor temperature in a previous cycle; and determine a rotational speed adjustment value of the outdoor fan according to the target temperature and the indoor temperature in the current cycle, and the target temperature and the indoor temperature in the previous cycle.

17. The air conditioner according to claim 12, wherein the outdoor unit further includes an outdoor fan and an outdoor heat exchanger;

the controller is further configured to:

after controlling the air conditioner to operate in the reheat dehumidification mode if determining that the first preset condition is satisfied, obtain a target temperature and an indoor temperature in a current cycle, and a target temperature and an indoor temperature in a previous cycle; and determine a rotational speed adjustment value of the outdoor fan according to the target temperature and the indoor temperature in the current cycle, and the target temperature and the indoor temperature in the previous cycle.

18. The air conditioner according to claim 13, wherein the outdoor unit further includes an outdoor fan and an outdoor heat exchanger;

the controller is further configured to:

after controlling the air conditioner to operate in the reheat dehumidification mode if determining that the first preset condition is satisfied, obtain a target temperature and an indoor temperature in a current cycle, and a target temperature and an indoor temperature in a previous cycle; and determine a rotational speed adjustment value of the outdoor fan according to the target temperature and the indoor temperature in the current cycle, and the target temperature and the indoor temperature in the previous cycle.

19. A control method of an air conditioner, wherein the air conditioner includes:

an outdoor unit including a compressor configured to compress a refrigerant;

an indoor unit including an indoor fan configured to supply air indoors;

a temperature sensor configured to detect a first indoor temperature and a second indoor temperature:

a humidity sensor configured to detect a first indoor humidity and a second indoor humidity; and a controller coupled to the compressor, the indoor fan, the temperature sensor, and the humidity sensor;

the control method comprises:

obtaining the first indoor temperature and a first target temperature at a first moment;

controlling the air conditioner to operate in a reheat dehumidification mode if determining that a first preset condition is satisfied; wherein the reheat dehumidification mode refers to a mode that the air conditioner heats dehumidified cold air before sending the dehumidified cold air indoors; and controlling the air conditioner to operate in a cooling mode if determining that the first preset condition is not satisfied;

wherein the first preset condition includes that the first indoor temperature is less than or equal to a sum of the first target temperature and a first preset temperature, and the first indoor temperature is greater than the first target temperature;

the control method further comprises:

after controlling the air conditioner to operate in the reheat dehumidification mode if determining that a first preset condition is satisfied, obtaining a target temperature and a target humidity in a current cycle;

determining a target evaporation temperature in the reheat dehumidification mode according to the target temperature and the target humidity in the current cycle; wherein the target evaporation temperature is a temperature that the indoor heat exchanger as an evaporator needs to reach; and adjusting a rotational speed of the compressor according to the target evaporation temperature.

20. The control method according to claim 19, wherein the control method further comprises:

after controlling the air conditioner to operate in the reheat dehumidification mode, obtaining the second indoor temperature and the second indoor humidity at a second moment;

controlling the air conditioner to enter a shutdown state if determining that one of a second preset condition and a third preset condition is satisfied; and controlling the air conditioner to continue to operate in the reheat dehumidification mode if determining that a fourth preset condition is satisfied:

wherein the second preset condition includes that the second indoor temperature is outside a temperature range, an upper limit value of the temperature range is equal to a sum of a second target temperature and a second preset temperature, and a lower limit value of the temperature range is equal to a difference between the second target temperature and the second preset temperature:

the third preset condition includes that the second indoor temperature is within the temperature range, and the second indoor humidity is less than or equal to a difference between a second target humidity and a first preset humidity; and the fourth preset condition includes that the second indoor temperature is within the temperature range.

* * * * *